US006802960B1

(12) United States Patent
Davies et al.

(10) Patent No.: US 6,802,960 B1
(45) Date of Patent: Oct. 12, 2004

(54) TWO STAGE EXTRACTION OIL TREATMENT PROCESS

(75) Inventors: John Philip Davies, Richmond (GB); Kellie Peta Grace, Victoria (AU)

(73) Assignees: BP Oil International Limited, London (GB); BP Refinery (Kwinana) Pty Limited, Western Australia (AU)

( * ) Notice: Subject to any disclaimer, the term of this patent is extended or adjusted under 35 U.S.C. 154(b) by 71 days.

(21) Appl. No.: 09/665,908

(22) Filed: Sep. 20, 2000

Related U.S. Application Data

(63) Continuation of application No. PCT/GB00/00635, filed on Feb. 23, 2000.

(30) Foreign Application Priority Data

Mar. 2, 1999 (GB) ..... 9904808

(51) Int. Cl.[7] ..... C01G 21/02

(52) U.S. Cl. ..... 208/311; 208/320; 208/322; 208/327; 208/330

(58) Field of Search ..... 208/311, 320, 208/322, 327, 330

(56) References Cited

U.S. PATENT DOCUMENTS

| | | | | |
|---|---|---|---|---|
| 3,205,167 | A | 9/1965 | Demeester | 208/291 |
| 4,990,238 | A | 2/1991 | Cruzan et al. | 208/18 |
| 5,034,119 | A | 7/1991 | Blackburn et al. | 208/309 |
| 5,846,405 | A | 12/1998 | Aldous et al. | 208/211 |

FOREIGN PATENT DOCUMENTS

| | | |
|---|---|---|
| DE | 2 343 238 | 3/1974 |
| DE | 3717820 C1 | 1/1989 |
| EP | 0 210 030 A2 | 1/1987 |
| EP | 0 417 980 A1 | 3/1991 |
| EP | 0839891 | 5/1998 |
| EP | 0892032 | 1/1999 |
| EP | 1106 673 A2 | 6/2001 |
| FR | 1 295 441 | 5/1962 |
| FR | 2 595 371 | 3/1986 |
| FR | 2595371 | 9/1987 |
| FR | 2685705 | 7/1993 |
| GB | 938769 | 10/1963 |
| GB | 1 426 746 | 3/1976 |
| HU | 169216 B | 10/1976 |
| WO | 98/44075 | 10/1998 |

OTHER PUBLICATIONS

Klamann, D. "Lubricants and related products, . . . ," Verlag Chem, pp. 57–58 and 346–350 (1984), No month.

Zakarian et al, "All–Hydroprocessing Route for High–Viscosity Index Lubes," Energy Progress, vol. 7, No. 1, pp. 59–64 (1987), No month.

CA 79:81090, Mills, A.L. "Lubricating Oils." –No month.

Esso Lubricant Handbook (1989) ed Esso Singapore Pte Ltd pp. 198–201, –No month.

Annual book of ASTM Standards. Section 5. Petroleum products, lubricants and . . . ISBN 0–8031–2468–6, –No date.

*Primary Examiner*—Walter D. Griffin
*Assistant Examiner*—Tam M. Nguyen
(74) *Attorney, Agent, or Firm*—Nixon & Vanderhye

(57) ABSTRACT

A process for the production of a process oil, the process comprising:

a) contacting a petroleum distillate with a polar solvent in an extraction column which operates with a bottom temperature of 30 to 80° C., b) withdrawing a primary raffinate from the column of step a), c) contacting the primary raffinate with a polar solvent in an extraction column which operates at a bottom temperature that is higher than the bottom temperature of the extraction column of step a), and in the range of 60 to 90° C., d) withdrawing a secondary extract from the column of step c), and e) removing said polar solvent from said secondary extract.

24 Claims, 1 Drawing Sheet

TWO STAGE EXTRACTION OIL TREATMENT PROCESS

This is a continuation of PCT application PCT/GB00/00635, filed Feb. 23, 2000, the entire content of which is hereby incorporated by reference in this application.

This invention relates to a process for the production of a process oil having an aromatic content of at least 20% by weight and a polycyclic aromatic (PCA) content of less than 3wt %. In this application, aromatic content is measured by the ASTM D 2007 method, and PCA content is measured by the IP 346 method.

BACKGROUND OF THE INVENTION

Process oils are hydrocarbon mixtures that boil in the same temperature range as lubricant base oils, and like lubricant base oils, are derived from petroleum distillates by solvent extraction. However, unlike lubricant base oils which are rarely employed outside the lubricating field, process oils have a wide range of industrial applications. For example, they are used as solvents, anti-dust compounds, plasticisers and/or extenders for synthetic and natural rubbers, and in the manufacture of printing inks. In order to be suitable for these applications, the compositions of process oils have to be carefully controlled.

Various methods of preparing process oils are known. For example, in GB 1426746, a petroleum distillate is contacted with furfural, and the resulting primary extract is re-extracted with furfural to produce a secondary extract and a pseudo-raffinate. The pseudo-raffinate is distilled from furfural, and then de-waxed and hydrogenated to produce a process oil.

A problem with this process is that it produces a process oil having a low aromatic content as a result of the hydrogenation step. Aromatic compounds, however, impart solvent and swelling properties, which are desirable for a number of applications. The polycyclic aromatic (PCA) content of a process oil, however, should be kept to a minimum, because such compounds are undesirable for health and environmental reasons.

In EP 0417980, a process oil having a high aromatic, and a PCA content of less than 3 weight % is prepared by re-extracting a primary extract under specific temperature and solvent conditions. Specifically, the process is carried out in an extraction column operating at an extract to solvent ratio of 1:1 to 1:1.8, a column head temperature of 50 to 90° C., and a bottom temperature of 20 to 60° C. The bottom temperature of the column is defined as the lowest temperature in the extraction step. The head temperature of the column is the temperature at the uppermost region of the column. Generally, it is the highest temperature in the column.

SUMMARY OF THE INVENTION

We have now discovered an alternative route for the production of process oils. Specifically, the present process involves extracting the primary raffinate under specific operating conditions to produce a process oil having an aromatic content of at least 20% by weight and a PCA content of less than 3 wt %.

FR 1 295 441 describes a process in which a primary raffinate is extracted in a second extraction step. However, the process conditions employed are such that process oils having the composition of the present invention are not produced.

Accordingly, the present invention provides a process for the production of a process oil, the process comprising:

a) contacting a petroleum distillate with a polar solvent in an extraction column which operates with a bottom temperature of 30 to 80° C., b) withdrawing a primary raffinate from the column of step a), c) contacting the primary raffinate with a polar solvent in an extraction column which operates at a bottom temperature that is higher than the bottom temperature of the extraction column of step a), and in the range of 60 to 90° C., d) withdrawing a secondary extract from the column of step c), and e) removing said polar solvent from said secondary extract.

The process oils produced by the present invention have an aromatic content of more than 20% by weight and a PCA content of less than 3% by weight. Such process oils are suitable for a number of applications, for example, as solvents, anti-dust compounds, plasticisers and/or extenders for synthetic and natural rubbers, and in the manufacture of printing inks.

In step a), the petroleum distillate is contacted with a polar solvent in an extraction column. Without wishing to be bound by any theory, the polar solvent is believed to remove at least some of the PCA compounds originally present in the petroleum distillate. The procedure produces two phases: a primary extract at a lower portion of the column, and a primary raffinate at an upper portion of the column. The primary extract is solvent-rich and comprises naphthenic, and polycyclic aromatic components. This extract is withdrawn from the base of the column. In a preferred embodiment, the polar solvent is removed from the extract and recycled.

Step a) may be carried out using an extraction column which operates at a bottom temperature of 30 to 80° C., preferably, 45 to 75° C., and especially 55 to 70° C. The bottom temperature of the first extraction step (a) is principally dependent on the temperature of the polar solvent and the petroleum distillate but may be controlled by additional cooling at the base of the extraction column. This temperature has an important influence on the selectivity and solvent power of the solvent employed in the present invention, which in turn, affects the final composition of the primary raffinate produced. In one embodiment, a temperature gradient is maintained along the extraction column, such that the head of the column is maintained at 80 to 120° C. (head column temperature), whilst the bottom temperature is maintained at 60 to 90° C. (base column temperature). The temperature difference between the head temperature and the bottom temperature is from 5 to 70° C., preferably 30 to 50° C.

The amount of solvent relative to petroleum distillate employed may be in the range of 70 to 300 vol %, preferably, 100 to 250 vol %, and especially, 120 to 170 vol %. It should be recognised, however, that the precise solvent to distillate ratio used will depend on the type of distillate employed. For example, the solvent to distillate ratio may depend on the boiling range of the distillate, and/or its crude origin.

The primary raffinate produced in step a) is withdrawn from an upper portion of the extraction column and re-extracted with a polar solvent in a second solvent extraction step (Step c). The procedure produces two phases: a secondary extract at a lower portion of the column, and a secondary raffinate at an upper portion of the column. In one embodiment, 70 to 100% of the polar solvent is removed from the primary raffinate, before the primary raffinate is treated in the second solvent extraction step. Preferably, 95 to 100% of the polar solvent is removed. The bottom temperature employed in step c) is in the range of 40 to 90° C., preferably, 55 to 90°, and especially 75 to 90° C. In one embodiment, step c) is carried out using an extraction column having a head column temperature of 90 to 130° C., and a bottom temperature of 70 to 100° C. The temperature difference between the head temperature and bottom temperatures is 5 to 70° C., preferably 30 to 50° C.

The bottom temperature of the second extraction step (c) is dependent on the temperature of the polar solvent and the primary raffinate. Like the bottom temperature of the first extraction step, however, the bottom temperature of the second extraction step may be controlled by additional cooling at the base of the extraction column. The second extraction step is carried out at a higher bottom temperature than step a). This increase in extraction temperature decreases the selectivity of the solvent. When the polar solvent is removed from the secondary extract in step e), a process oil having a PCA concentration of 3 wt % or less is produced. The overall aromatic content of the process oil is more than 20% by weight. The less soluble paraffinic components of the primary raffinate accumulate at an upper portion of the solvent extraction column as a secondary raffinate. This raffinate may be removed from the column, and distilled. The solvent recovered may be recycled for re-use. In one embodiment, the secondary raffinate is purified in distillation column, and then solvent dewaxed to produce a lubricant base oil (e.g. 500N with 96 VI).

Step c) may be performed using a different extraction column to step a). Preferably, however, the same extraction column is employed for both steps.

The amount of solvent relative to petroleum distillate in the second extraction step employed may be in the range of 100 to 400 vol %, preferably, 180 to 300 vol %, and especially, 200 to 250 vol %. As with the first extraction step, the precise solvent to distillate ratio used will depend on the type of distillate employed. For example, the solvent to distillate ratio may depend on the boiling range of the distillate, and/or its crude origin.

Suitable polar solvents for solvent-extraction steps a) and c) include furfural, phenol and N-methylpyrrolidone. Preferably, furfural is employed.

BRIEF DESCRIPTION OF THE DRAWINGS

These and other aspects of the present invention will now be described with reference to the accompanying drawing, which is a schematic view of an apparatus for use in a preferred embodiment of the present invention.

DETAILED DESCRIPTION OF PREFERRED EMBODIMENTS

Figure 1:
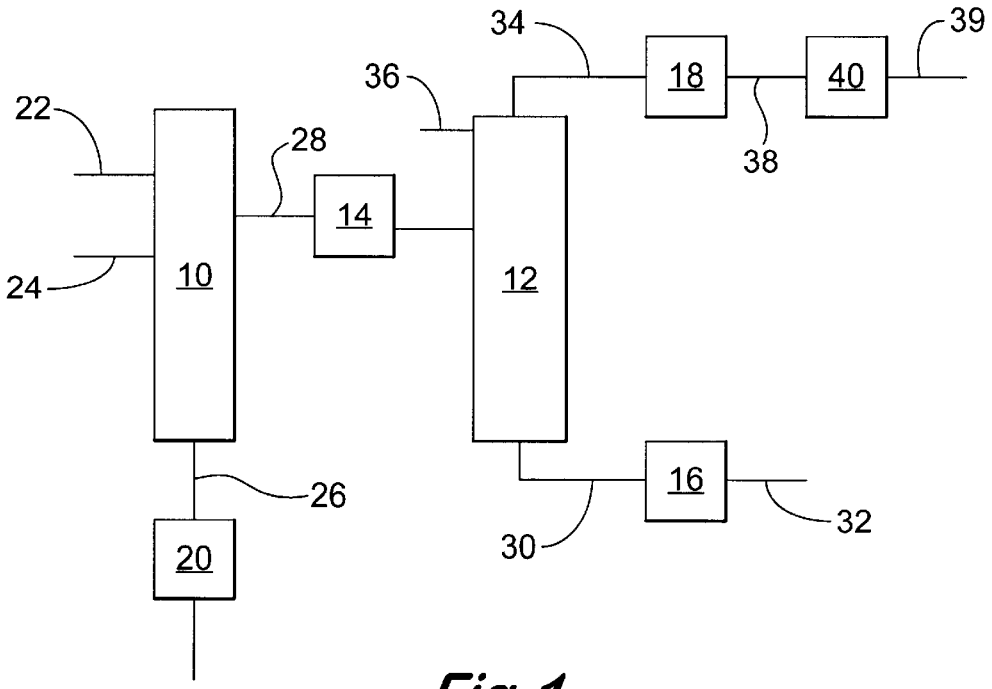

The drawing depicts an apparatus which comprises a first extraction column 10, a second extraction column 12, and four distillation columns 14, 16, 18 and 20.

In use, a petroleum distillate 24 is fed into the first extraction column 10 and contacted with furfural, which is fed into the extraction column 10 via line 22 The column 10 is operated at a bottom temperature of 70° C. The temperature at the head of the column 10 is 109 to 118° C. At least some of the polycyclic aromatic and naphthenic components in the distillate 24 dissolve in the furfural to form a primary extract 26. This is withdrawn from the base of the first extraction column 10, and is introduced into a distillation column 20 for purification. Once distilled, the extract is removed for disposal or otherwise.

The remaining components of the distillate 24 are withdrawn from the first extraction column 10 as a primary raffinate 28. The density of the raffinate 28 is measured at regular intervals to provide an indication of the PCA content of the raffinate.

The primary raffinate 28 is then introduced into a distillation column 14. The raffinate is isolated from the solvent, and introduced into the second extraction column 12 for further solvent extraction. Fresh furfural is introduced into the column 14 via line 36. The second extraction step is carried out at a bottom temperature of 75° C. The head temperatures of the column is 107 to 115° C. The extraction step produces two phases: a secondary extract 30 at the base of the column 12, and a secondary raffinate 34 at the column head. The secondary extract 30 is withdrawn from the second extraction column 12 and purified in distillation column 16 to produce a process oil 32 having a polycyclic aromatic (PCA) content of less than 3% by weight, and an aromatic content of more than 20% by weight. As with the primary raffinate 28, the density of the secondary extract 30 is determined to provide an indication of the PCA content of the extract 30.

The less soluble components of the primary raffinate 28 are withdrawn from the head of the second extraction column 12 as a secondary raffinate 34. This secondary raffinate 34 is purified in distillation column 18 to produce a solvent-free raffinate 38 which is introduced into a solvent de-waxing unit 40. After solvent dewaxing to −9° C. pour point, a lubricant base oil (500N with 96 VI) 39 is produced.

The furfural recovered in columns 14, 16, 18 and 20 is recovered for re-use.

Instead of using two extraction columns, it is possible to use the same column for both extraction stages.

EXAMPLE

In this Example, a waxy distillate obtained from Middle East crude suitable for lubricant base oil production is treated using the apparatus of FIG. 1.

This distillate is fed into the first extraction column at a temperature of 77° C. Furfural is preheated to 118° C., and introduced into the first extraction column at a furfural to distillate ratio of 130 vol %. The extraction column is operated at a bottom temperature of 70° C. The temperature at the head of the column is 109° C. The process conditions employed in the first solvent extraction stage are summarised in Table 2 below.

TABLE 2

| | |
|---|---|
| primary raffinate yield | 71% vol |
| primary raffinate density at 70° C. | 0.856 g/ml |
| primary extract density at 70° C. | 1.006 g/ml |

In the second solvent extraction stage, the primary raffinate is fed into the second extraction column at 77° C. Furfural is preheated to 115° C., and introduced into the extraction column at a wash rate of 260 vol %. The second extraction column is operated at a bottom temperature of 75° C. The temperature at the head of the column is 107° C. The process conditions employed in the second solvent extraction stage are summarised in Table 3 below.

TABLE 3

| | |
|---|---|
| secondary raffinate yield | 80 vol % |
| secondary raffinate density at 70° C. | 0.842 g/ml |
| secondary extract density at 70° C. | 0.926 g/ml |

The secondary extract produced in this Example was analysed and found to have a IP 346 PCA content of 2.85 wt %, and an ASTM D-2007 aromatic content of 28 wt %. The VGC of the extract was measured using the ASTM D2140 test method, and found to be 0.90. The aniline point of the extract, as measured using ASTM D611, was 62.4° C.

Various modifications may be made to the embodiment described above without departing from the scope of this invention. For example, instead of using density measurements to provide an indication of the PCA content of a particular extract and/or raffinate, refractive index, near infra-red spectroscopy or chromatographic techniques may also be employed.

What is claimed is:

1. A process for the production of a process oil, the process comprising:

a) contacting a petroleum distillate with a polar solvent in an extraction column which operates with a bottom temperature of 30 to 80° C.;

b) withdrawing a primary raffinate from the column of step a), and removing, in a distillation column, 70–100% of the polar solvent from step a) from the primary raffinate;

c) contacting the primary raffinate with a polar solvent in an extraction column which operates at a bottom temperature that is higher than the bottom temperature of the extraction column of step a), and in the range of 40 to 90° C.;

d) withdrawing a secondary extract from the column of step c); and e) removing said polar solvent from said secondary extract.

2. A process as claimed in claim 1, wherein the temperature difference in the column of step a) between the temperature of the head of the column and the bottom temperature is from 5 to 70° C.

3. A process as claimed in claim 1, wherein the temperature difference in the column of step c) between the head temperature and bottom temperatures is 5 to 70° C.

4. A process as claimed in claim 2, wherein the temperature difference in the column of step c) between the head temperature and bottom temperatures is 5 to 70° C.

5. A process as claimed in claim 1, wherein the ratio of solvent to petroleum distillate employed in step a) is in the range of 70 to 300 vol %.

6. A process as claimed in claim 1, wherein prior to contacting the primary raffinate with a polar solvent in step c), 95–100% of the polar solvent from step a) is removed from the primary raffinate.

7. A process as claimed in claim 1, wherein step c) is performed using the same extraction column as step a).

8. A process as claimed in claim 1, wherein the ratio of solvent to petroleum distillate employed in step c) is in the range of 100 to 400 vol %.

9. A process according to claim 5, wherein the ratio of solvent to petroleum distillate employed in step c) is in the range of 100 to 400 vol %.

10. A process according to claim 5 wherein prior to contacting the primary raffinate with a polar solvent in step c), 95–100% of the polar solvent from step a) is removed from the primary raffinate.

11. A process according to claim 6, wherein the ratio of solvent to petroleum distillate employed in step c) is in the range of 100 to 400 vol %.

12. A process according to claim 9 wherein prior to contacting the primary raffinate with a polar solvent in step c), 95–100% of the polar solvent from step a) is removed from the primary raffinate.

13. A process as claimed in claim 1, wherein the polar solvent for solvent-extraction steps a) and c) is selected from the group consisting of: furfural, phenol and N-methylpyrrolidone.

14. A process according to claim 1 wherein the oil process has an aromatic content of more than 20 wt % and a PCA of less than 3 wt %.

15. A process for the production of a process oil, the process comprising:

a) contacting a petroleum distillate with a polar solvent in an extraction column wherein a temperature gradient is maintained along the extraction column, such that the temperature of the head of the column is maintained at 80 to 120° C. and the bottom temperature is maintained at 60 to 90° C.;

b) withdrawing a primary raffinate from the column of step a), and removing, in a distillation column, 70–100% of the polar solvent from step a) from the primary raffinate;

c) contacting the primary raffinate with a polar solvent in an extraction column which operates at a bottom temperature that is higher than the bottom temperature of the extraction column of step a), and having a head column temperature of 90 to 130° C., and a bottom temperature of 70 to 100° C.;

d) withdrawing a secondary extract from the column of step c); and e) removing said polar solvent from said secondary extract.

16. A process as claimed in claim 15, wherein the ratio of solvent to petroleum distillate employed in step a) is in the range of 70 to 300 vol %.

17. A process as claimed in claim 15, wherein prior to contacting the primary raffinate with a polar solvent in step c), 95–100% of the polar solvent from step a) is removed from the primary raffinate.

18. A process as claimed in claim 15, wherein step c) is performed using the same extraction column as step a).

19. A process as claimed in claim 15, wherein the ratio of solvent to petroleum distillate employed in step c) is in the range of 100 to 400 vol %.

20. A process according to claim 16 wherein the ratio of solvent to petroleum distillate employed in step c) is in the range of 100 to 400 vol %.

21. A process according to claim 16 wherein prior to contacting the primary raffinate with a polar solvent in step c), 95–100% of the polar solvent from step a) is removed from the primary raffinate.

22. A process according to claim 17 wherein the ratio of solvent to petroleum distillate employed in step c) is in the range of 100 to 400 vol %.

23. A process according to claim 20 wherein prior to contacting the primary raffinate with a polar solvent in step c), 95–100% of the polar solvent from step a) is removed from the primary raffinate.

24. A process as claimed in claim 15, wherein the polar solvent for solvent-extraction steps a) and c) is selected from the group consisting of: furfural, phenol and N-methylpyrrolidone.

* * * * *